United States Patent [19]

Holz, Sr. et al.

[11] B 3,936,212

[45] Feb. 3, 1976

[54] RIDE-TYPE SURFACE-WORKING MACHINES

[75] Inventors: Orville H. Holz, Sr., Palm Harbor, Fla.; Norbert J. Holz, Roselle, Ill.

[73] Assignee: Orville H. Holz, Jr., Roselle, Ill. ; a part interest

[22] Filed: May 14, 1973

[21] Appl. No.: 359,740

[44] Published under the Trial Voluntary Protest Program on January 28, 1975 as document no. B 359,740.

Related U.S. Application Data

[63] Continuation-in-part of Ser. No. 258,589, June 1, 1972, abandoned.

[52] U.S. Cl. ..... 404/112

[51] Int. Cl.[2] ..... E01C 19/22

[58] Field of Search ..... 404/112

[56] References Cited

UNITED STATES PATENTS

| | | | |
|---|---|---|---|
| 2,342,445 | 2/1944 | Allen | 404/112 |
| 2,689,507 | 9/1954 | McCrery | 404/112 |
| 2,869,442 | 1/1959 | Mincher | 404/112 |
| 2,887,934 | 5/1959 | Whiteman | 404/112 |
| 2,898,826 | 8/1959 | Livermont | 404/112 |
| 2,983,203 | 5/1961 | Fletcher | 404/112 |
| 3,091,158 | 5/1963 | Bunger | 404/112 |
| 3,791,754 | 2/1974 | Zochil | 404/112 |

*Primary Examiner*—Nile C. Byers, Jr.
*Attorney, Agent, or Firm*—Darbo, Robertson & Vandenburgh

[57] ABSTRACT

In a machine for troweling large areas of concrete without having a footprint problem, the operator rides on a frame supported by a plurality of troweling rotors, preferably three. Each troweling rotor has three or four troweling blades, the pitch of which is controlled as before except that the pitch control is extended from all rotors to be jointly controlled, or at least separately accessible to the operator in the operator's seat. In addition, the operator can steer the apparatus in all respects by applying a tilting pressure to one or more rotors with selectivity as to the points along the rotor paths at which the increased downward pressure is applied. For ordinary steering, and for forward or reverse movement control, a control stick is provided which swings universally. Forward or rearward swinging of the stick causes forward and rearward movement. Right or left swinging of the stick causes or adds turning to right or left. The machine can also be made to "crab" right or left with right or left movement of the control stick and at the same time by a foot pedal.

15 Claims, 24 Drawing Figures

RIDE-TYPE SURFACE-WORKING MACHINES

This application is a continuation-in-part of application Ser. No. 258,589, filed June 1, 1972, now abandoned.

BACKGROUND AND SUMMARY OF THE INVENTION

The invention of which the present disclosure is offered for public dissemination in the event adequate patent protection is available relates in general to surface-working machines, of which one of the most important classes is concrete troweling machines. Troweling machines of the walk-behind type are widely used and are highly satisfactory for small or relatively narrow areas which permit the operator to move the machine to all parts of the surface without stepping on the unset concrete. For larger areas they are subject to the rather serious objection or nuisance caused by the operator's tracks in the concrete. In spite of all that may be done to minimize the track problem, it is usually necessary for the operator to keep working backwards so as to trowel out whatever tracks he produces. A riding-machine for surface-working has been patented, as U.S. Pat. No. 2,869,442, but so far as known it has not proved to be practicable, and it would appear to have serious faults such as inadequate steering. According to the present invention, a thoroughly practicable riding-type troweling-machine (or other surface-working machine) is provided. It uses a plurality of spaced apart troweling rotors, each corresponding to a prior troweling machine. The number preferred in some respects is three, arranged in triangular pattern (however, there can be only two and there could be any number more than three by extending the basic principles and linkages), with the weight of the driving motor and the operator, and the frame and controlling equipment, approximately equally divided among the three rotors. Great stability of action is provided because there can be rather wide inequalities of the weight division among the three rotors without causing any ill effects. If desired, weights may be added for some operations.

Each of the rotors rotates in only one direction and engages the concrete solely with a plurality of trowels, typically three or four, orbiting about the axis of the rotor. The rotationally leading edge of each trowel is curved upwardly and the pitch of all trowels can be controlled during rotation by raising its leading edge, this pitch control being old in individual troweling rotors.

According to the present invention, the direction of movement of the machine and its turning to face in a chosen direction are controlled by selectively applying to one or more of the rotors a tilting pressure. The tilting pressure applies to a chosen side of the rotor an increased pressure of the orbiting trowels on the concrete so that reaction to the increased friction along one side of the orbit exerts a moving force. Most of the time, it is enough that control be exerted through a control stick which the operator can swing forwardly and rearwardly about one axis and left to right about another axis, the movement being universal so that any combination of the two swinging movements may be used. Thus the operator can move the handle straight forwardly for forward movement, straight rearwardly for rearward movement; and with either of these movements can also move the handle sidewise for turning in one direction or the other as the vehicle moves forwardly or rearwardly. If the operator chooses to turn the vehicle with little or no movement forwardly or rearwardly, he can merely move the stick to one side or the other from the neutral position. The stick applies pressure to one rotor in a direction to produce lateral movement by that rotor and simultaneously influences one of the other rotors for forward movement and the other for rearward movement. If crab-like or directly sideward movement is desired, this can be accomplished by applying a pressure to all three rotors at a point selected for inducing movement in a single lateral direction, a foot control applying this pressure to the rotors not given lateral-movement pressure by the stick.

The machine is thus supported entirely by the trowels of its rotors and is nevertheless supported with great stability and may be controlled for all machine movements and steering that could possibly be desired.

Tests have indicated advantages of the apparatus which might be surprising. The results of the troweling in a given time are exceptionally good, perhaps due to the weight of the operator, and the stability of the machine. Of course, the weight of the operator increases the drag on the trowels and requires more power to drive the rotors. Nevertheless, an engine horsepower not much more than three times that common for a single rotor has been found to be sufficient for three rotors with an operator's weight added.

Advantages and objects of the invention will be more clearly apparent from the following description and from the drawings.

DESIGNATION OF FIGURES

INTENT CLAUSE

Figure 1:
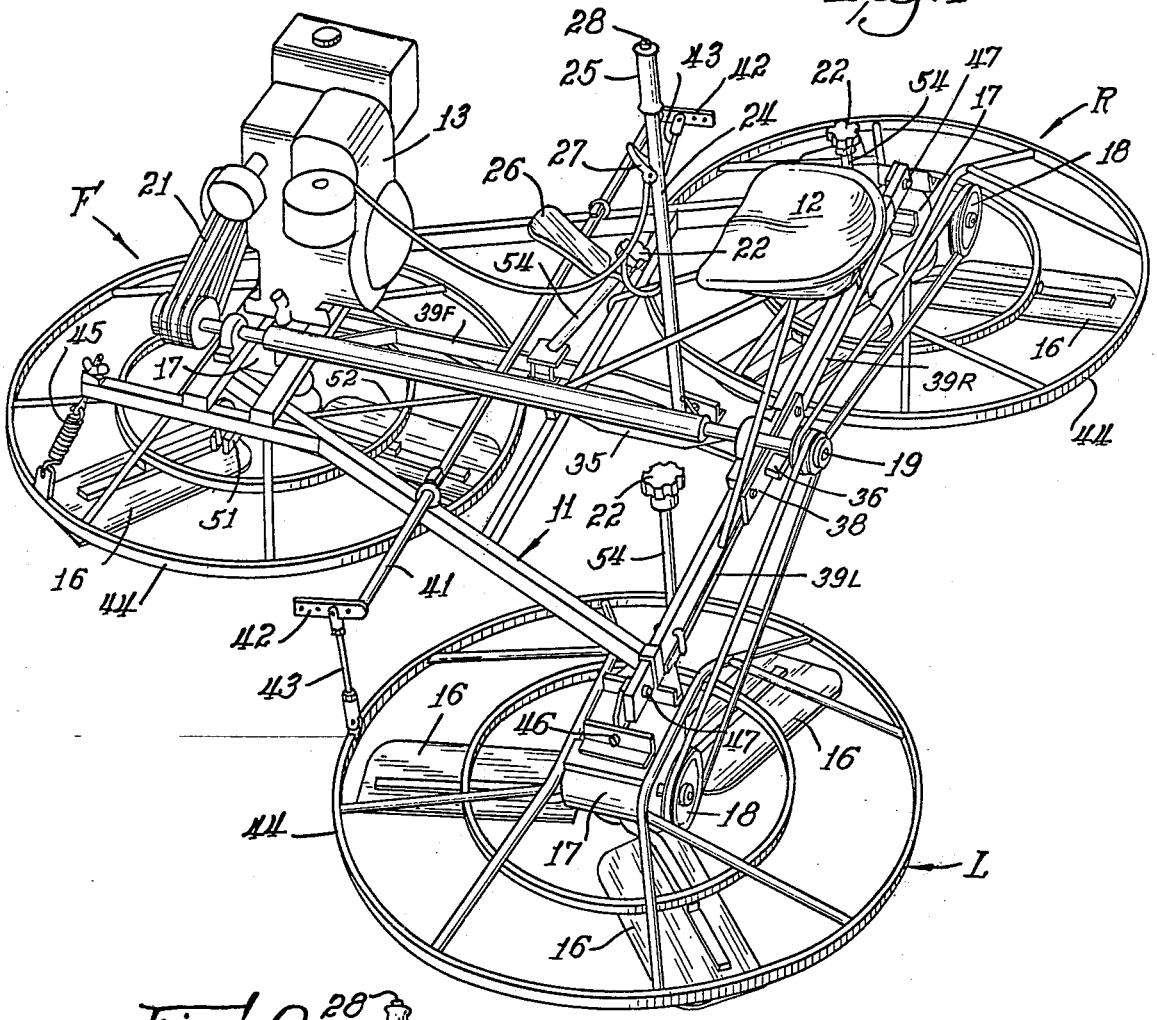
FIG. 1 is a perspective type view of the form of the invention chosen for illustration.

Although the following disclosure offered for public dissemination is detailed to ensure adequacy and aid understanding, this is jot intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

GENERAL DESCRIPTION OF THE INVENTION

The illustrated form of troweling machine in FIGS. 1 to 16 includes a triangular frame 11 on which are carried operator'operator3 s seat 12 and an internal combustion engine 13. Near each of the three corners of the frame 11, the frame is supported by a troweling-rotor assembly. Such assemblies are already well known, one such assembly being includes as part of single-rotor troweling machanes already common. For distinction of position, the three troweling assemblies are respectively designated F, R and L. The assembly or end of the machine in front of the operator's seat 12 is regarded as the front, regardless of which way the machine may move.

Each of the rotor assemblies F, R and L includes a rotor 14 which has been illustrated as including three blades 16. All three rotors 14 are driven by motor 13 through a gear box 17 for each rotor. The input 18 of each gear box is belt-driven by a drive shaft 19, which may be driven by engine 13 through multiple V-belts 21.

An operator sitting in seat 12 can control the pitch of the blades 16, separately for each rotor, by the respective hand knobs 22. Assuming that the engine 13 is running constantly, he can also control the movement of the machine forward, backward, turning right or turning left, by operation of control stick 24 having a handle 25 at its top. Foot lever 26 may be tilted forwardly or rearwardly from its normal position for causing a "crabbing" or sidewise movement of the machine, usually in conjunction with movement of the control stick 24. The control stick 24 carries a hand throttle 27, although it will not ordinarily be changed during normal operation of the machine. At the top of handle 25 there is preferably a button 28 for stopping the engine.

MOVEMENT CONTROL SYSTEM

In a sense the machine of this invention is a vehicle, more specifically a surface-working vehicle. Unlike more common vehicles, it has no wheels rolling on the supporting surface for driving the vehicle and for steering it. According to the present invention the necessary driving and steering of the surface-working vehicle is accomplished by selectively applying a tilt pressure to one or more of its surface-working rotors, namely (in the three-rotor form) F, R and L.

The tendency of a troweling rotor to advance in one direction or another depending upon a tilting force applied to it has been well known in connection with the common single-rotor troweling machines. The tilting pressure increases the frictional forces on one side of the rotor and reduces them on the other side, and the differential of friction causes the rotor to move. Each rotor tends to move in a direction parallel to the tangent to the point of greatest pressure on the work surface. With a tilting pressure applied oppositely, i.e. with greatest pressure at the opposite end of the diameter of the rotor, the movement tends to be in the opposite direction.

The simple controls of the present invention provide a wide variety of movement-controlling tilting-pressures. Most of the time these pressures will be controlled entirely by the control stick 24. As seen best in FIG. 13, this control stick 24 is carried, by journal 29, on one arm 31 of L-bar 32, the other leg 33 of which is journaled in fixed sleeve 34. The sleeve 34 may be welded to angle bar 35 which is rigid with, and may be considered part of, frame 11. It is thus seen that control stick 24 may be rocked forwardly and rearwardly about arm 31 and left and right arm 33.

Figure 7:
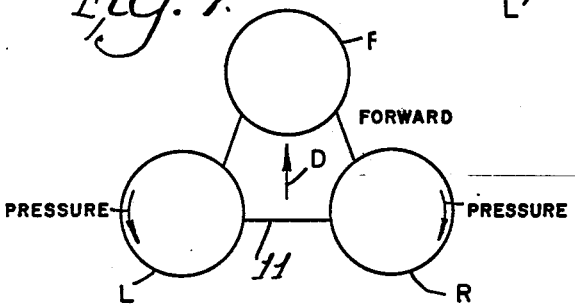
FIGS. 7 to 12 are diagrammatic illustrations indicating the effects of applying tilting pressure at various points on the various rotors.

Considering first only forward and rearward movements of control stick 24, these swing control bar for arm 36 upwardly or downwardly about arm 31 which is assumed to be stationary for the present. Arm 36 is rigidly connected to control stick 24 by a brace 37 and hence the assembly is in the nature of a bell crank lever. When arm 36 is raised, it raises toggle plate 38. As seen best in FIG. 15, this raises the ends of two rotor-tilt levers 39L and 39R. This applies pressure at the right hand edge of rotor R and at the left hand edge of rotor L. Referring now to FIG. 7, this condition is indicated by the arrows shown on the respective rotors R and L. The direction of the arrow indicates the direction of rotation of the rotor and the position of the arrow indicates the point of greatest pressure on the work surface. In this assumed instance, the friction at both of the points of greatest pressure tends to move the machine forwardly, and this movement is indicated by directional arrow D in the center of frame 11. In the various figures, the arrow D is changed to represent the movement of the frame in that figure.

Figure 8:
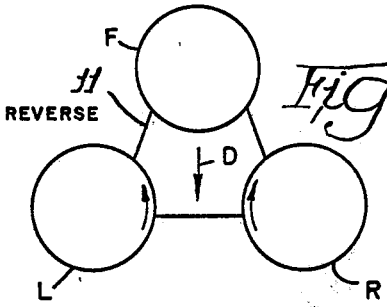
Figure 13:
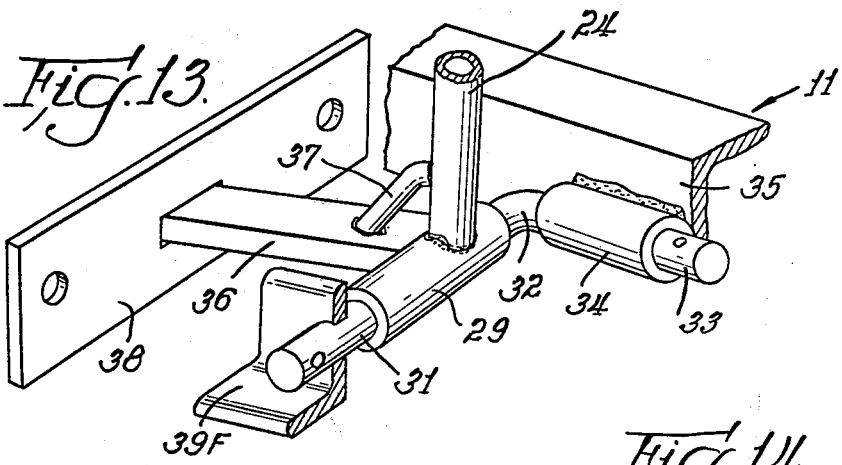
FIG. 13 is a detail of perspective nature showing the mounting of the control stick and its connection to actuated members.
Figure 14:
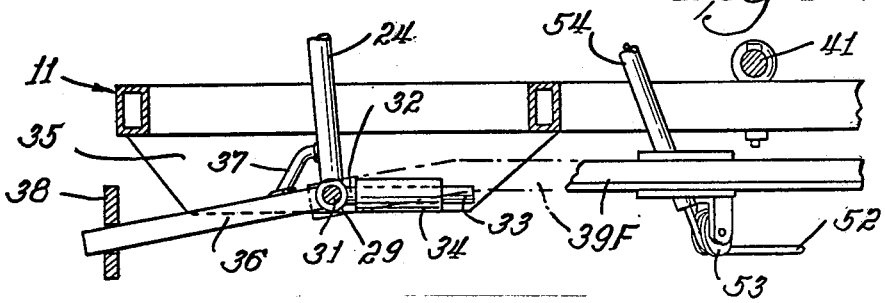
FIG. 14 is a view of vertical longitudinal sectional nature showing control stick details and control details for adjusting the tilt of the forward rotor.
Figure 15:
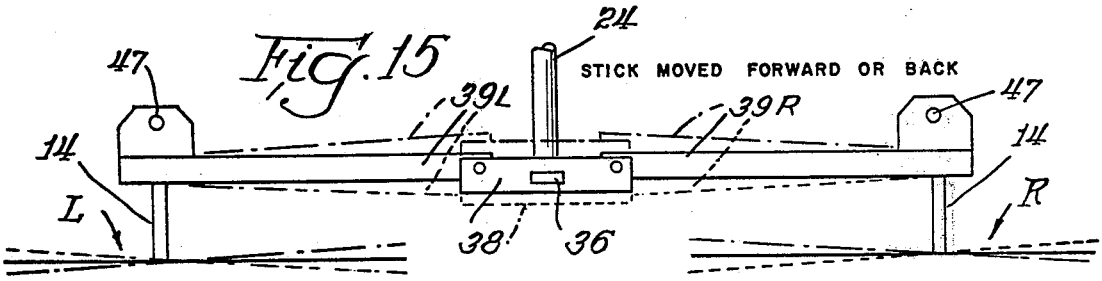
FIGS. 15 and 16 are diagrammatic views showing two different tilting operations of the two rear rotors, FIG. 15 when the control stick is moved forwardly or backwardly and FIG. 16 showing the effect of sidewise swing of the control stick.
Figure 16:
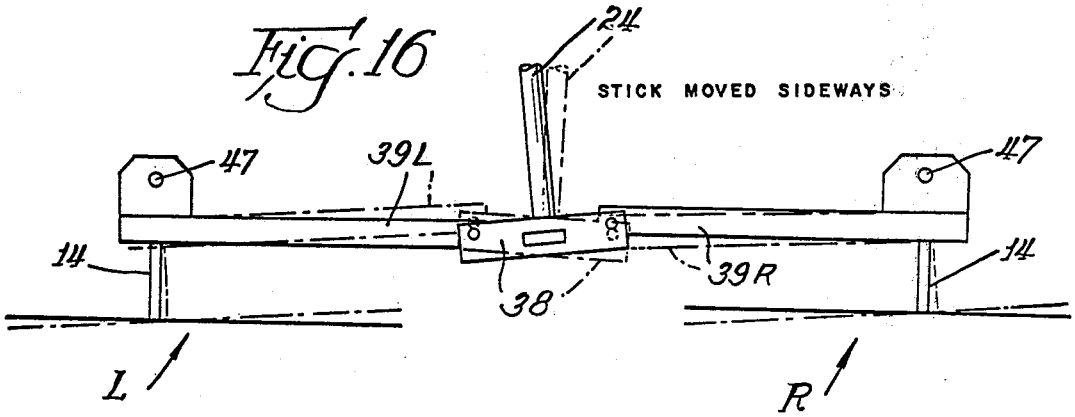

Thus, if we look again at FIGS. 13 to 15 and assume that control stick 24 is swung rearwardly thereby lowering lever 36 and toggle plate 38, this will lower the coupled ends of levers 39R and 39L tilting the rotors R and L oppositely to the tilting just described, and the result will be as seen in FIG. 8. There the pressure points are seen to be at the inside edges of the two rotors L and R. Although the direction of rotation of these rotors remains the same, the pressure points are now on forwardly moving parts of these rotors so that the frictional reaction is to move the machine rearwardly as is indicated in FIG. 8 by the arrow D.

Figure 2:
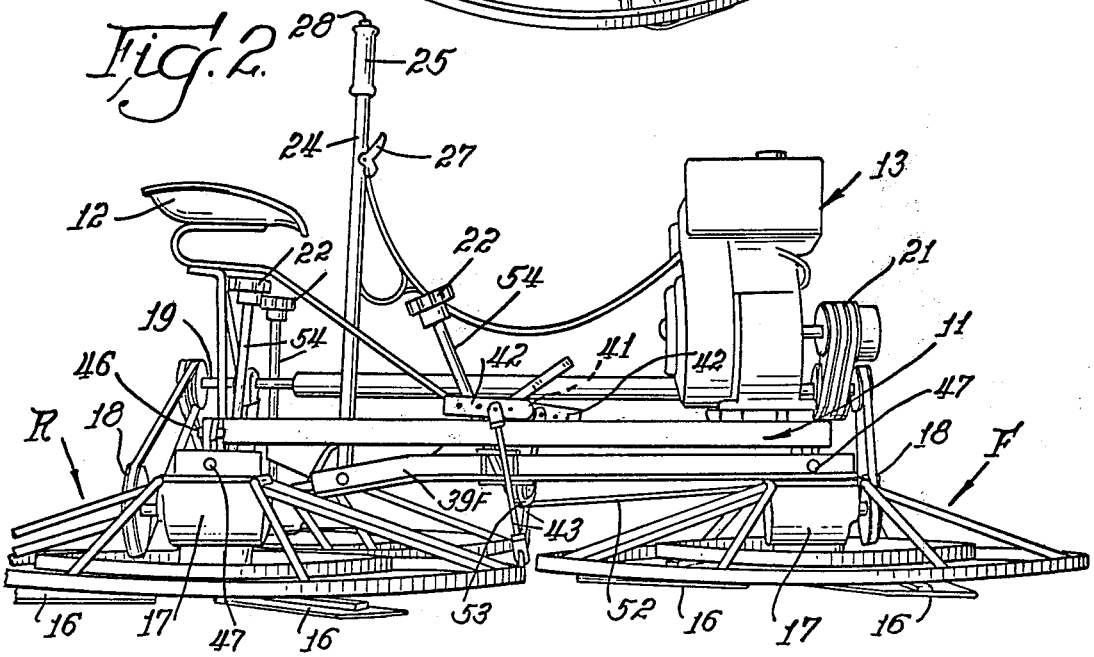
FIGS. 2 to 5 are views of the apparatus shown in FIG. 1 as seen, respectively, from the right side, the front, the rear and the left side.
Figure 9:
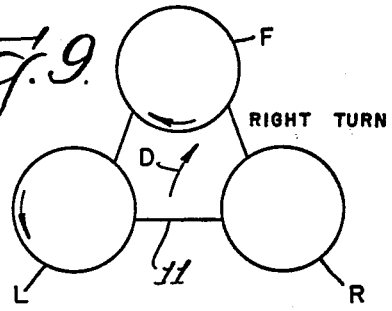
Figure 10:
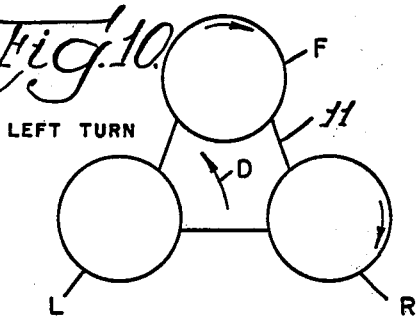
Figure 11:
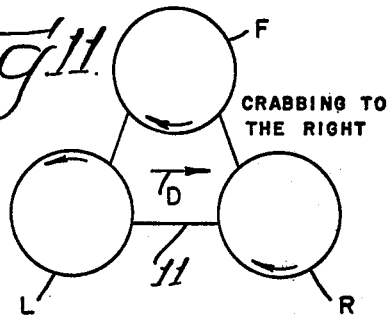

Again looking at FIG. 13, it is apparent that if the control stick 24 is swung left or right to rock about the arm 33, tilt lever 39F will be lowered or raised, respectively. The full length of this tilt lever is seen in FIG. 2, from which it can be seen that lowering tilt lever 39F (by swinging control stick 24 to the right) applies increased pressure to the rearmost tip of rotor F, as is indicated in FIG. 9 by the position of the arrow on rotor F. In view of the direction of rotation of rotor F, indicated by the direction of the arrow, this increased pressure tends to move rotor F to the right. This then produces a right hand swinging of the frame as is indicated by the arcuate shape of the arrow D. If the control stick 24 is moved to the left, it raises tilt lever 39F and tends to apply pressure to the foremost tip of forward rotor F as indicated in FIG. 10 by the position of the arrow there, and this tends to produce a leftward swing of the frame 11 as indicated in FIG. 11 by the arrow D.

The swinging right or swinging left is enhanced in the preferred form of the invention by simultaneously applying a tilting pressure on the outer rotor of the turn. As seen in FIG. 13, the lever 36 is a flat lever engaging a snug flat slot in the toggle plate 38. Accordingly, when control stick 24 is tilted right or left, the toggle plate 38 is likewise tilted. This tilting of toggle plate 38 has the action illustrated in FIG. 16 of moving one of the tilt bars 39R and 39L upwardly, and the other downwardly. FIG. 9 illustrates the effect of the upward movement of tilt bar 39L by indicating a pressure at the outermost point of rotor L, which tends to move rotor L forwardly, thereby aiding in the swinging action represented by the arrow D. In FIG. 10, the effect of upward movement of tilt lever 39R has been indicated by the arrow on rotor R. Here it is seen that this tends to move rotor R forwardly thereby aiding the left-hand swing represented by the arrow D.

Most operators will probably swing control stick 24 left or right only (or most often) when it is already swung forwardly or rearwardly. Assuming that it is swung forwardly for forward movement, swinging it also to the right or left will have much the effect of turning the steering wheel on a forwardly moving car right or left. When the rocking of toggle plate 38 raises one of the tilt levers 39L, R, it tends to lower the other. However, this action is usually superimposed upon the raising or lowering of toggle plate 38 by the forward or rearward movement of control stick 24, so that the two effects on the "inside" rotor will partially or fully offset each other depending on the relative movements from the two causes, and hence no attempt has been made to show what pressure would be on the inside rotor, rotor R in FIG. 9 or rotor L in FIG. 10.

Occasionally a crabbing movement is desired, that is, a movement of the entire machine to right or left without turning it. For example, if the machine were already faced in a direction parallel to an edge of the area to be troweled, and was near that edge, a crabbing movement over to that edge would place the machine in readiness to proceed along that edge.

According to the present invention now under discussion, crabbing is accomplished through pedal 26, or by operation of that pedal jointly with side swinging of control stick 24. The effect of side swinging of control stick 24 in causing the forward rotor F to move left or right has already been described. Heretofore it was assumed that this would swing the frame 11. However, pedal 26 can be actuated to cause similar action by rotors R and L so that the frame does not swing but moves crabwise. Pedal 26 rocks shaft 41 which may be called the crabbing shaft. Shaft 41 carries at each end, rigidly mounted to the shaft, a crabbing lever 42. The two crabbing levers are coupled by links 43 to the forward tips of rings 44 which are part of the rotor assemblies. One of the levers 42 extends rearwardly while the other extends forwardly. As seen best in FIG. 1, pressing the heel of pedal 26 will rock shaft 41 in a direction to raise the front end of rotor L, while pressing the toe of pedal 26 would lower the front end of rotor L. The action on rotor R is exactly the opposite.

FIG. 11 illustrates the effect of swinging control stick 24 to the right and pushing the toe of pedal 26 downwardly. On all three rotors F, R and L, the position of the arrow is such as to cause the rotor to advance to the right. This is indicated by the arrow D.

Figure 12:
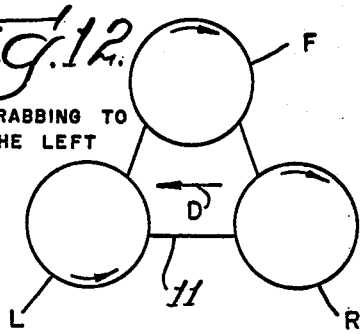

FIG. 12 shows the opposite effect in which the control stick 24 is swung to the left and the heel of pedal 26 is pressed downwardly. In this instance the positions of the arrows on the rotors F, R and L indicates pressures at points producing movement to the left, so that the frame 11 crabs to the left as indicated by the arrow D.

For simplicity the foregoing description has ignored some considerations which result in the foregoing description being somewhat oversimplified. Though accurate in theory, actual practice is a little different. For example, the belt tensions exert a tilting force on the rotors. In the case of the rear rotors, this tends to make the machine move forwardly, and hence if the control stick is left alone, the machine may move forward slowly, at least if the belts are quite tight. In that case, the first rearward movement of the control stick would reduce or stop the forward movement and only further rearward movement of the control stick would actually produce rearward movement. This is unobjectionable and may even be advantageous.

It has been found best to apply a compensating tilting force to forward rotor F. As seen in FIG. 1, this is accomplished by a coil tension spring 45. The position shown in FIG. 6, about midway between the left extremity and the forward extremity of rotor F, has been found to give good results. The tension is screw-adjustable. Without some such compensation, the machine tends to swing to the left. This is due to the fact that the friction at the front of the forward rotor has a longer torque arm for swinging the machine than does the equal friction at the rear of the front rotor. The location of spring 45, nearly at the middle of the left-hand front quadrant, is chosen because it gives a slight forward-moving component. If a given operator prefers rearward movement, the spring 45 could be located near the middle of the right-hand front quadrant.

For the various tilt pressures contemplated, each of the rotor assemblies is connected to frame 11 by a universal mounting. Thus as is perhaps seen best in FIG. 3, each of the rotor assemblies can rock about pins 46 and 47 which extend horizontally in vertical planes at right angles to each other.

Control stick 24 and rearwardly extending arm 36 have been shown mounted as close as is convenient to the axis of arm 33 about which they rock upon left or right swinging of control stick 24. Ideally, arm 36 should be centered on that axis but the slight departure from this ideal location seems to cause no toruble. If a slight unintended forward or rearward action results from the offset location, it is readily compensated by forward or rearward movement of the control stick 24.

PITCH CONTROL

Figure 3:
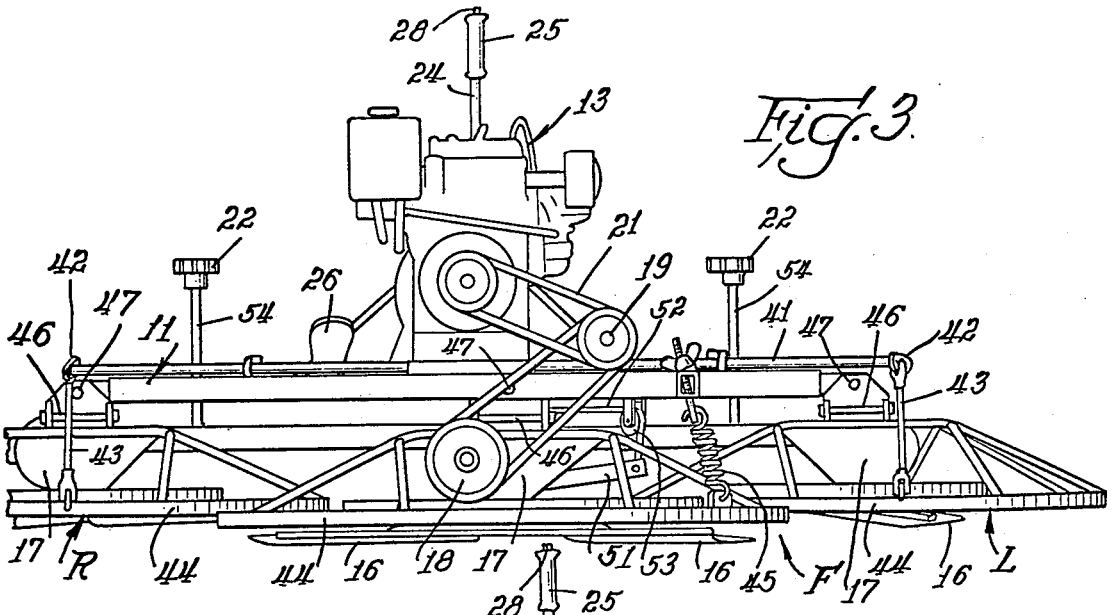
Figure 4:
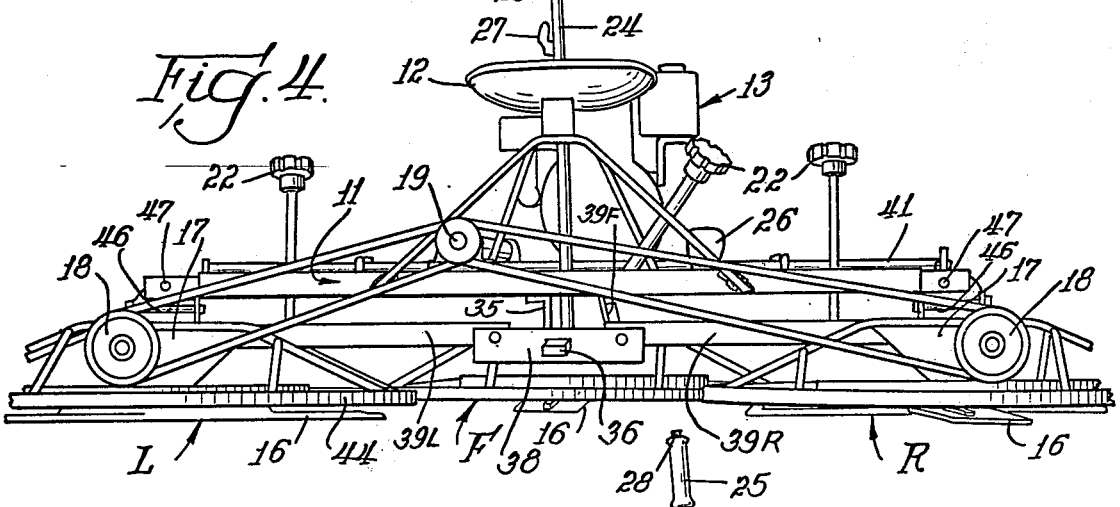
Figure 5:
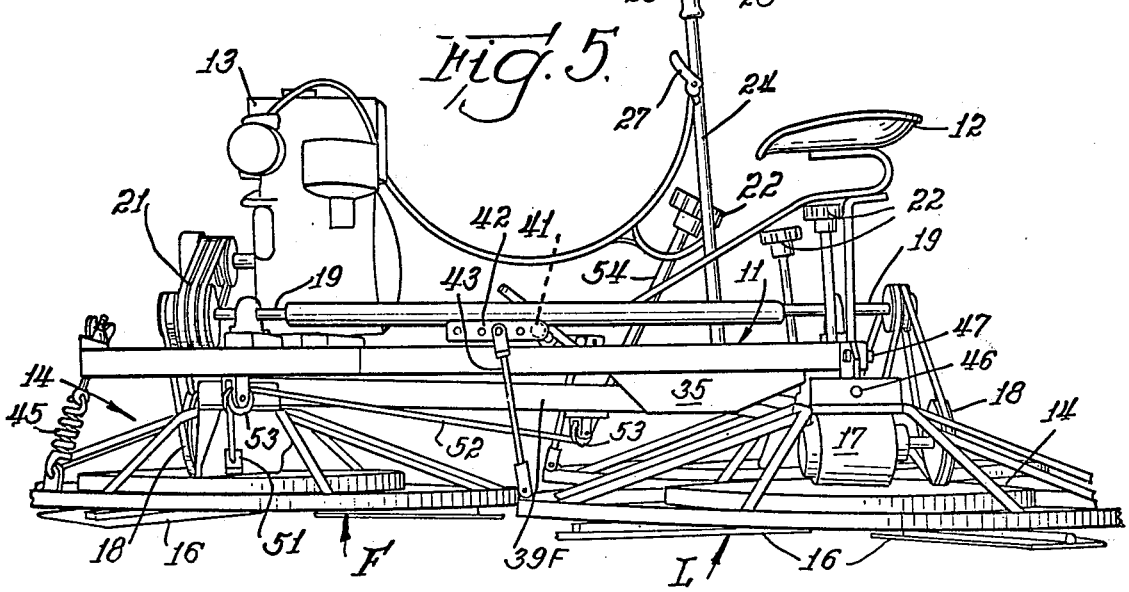
Figure 6:
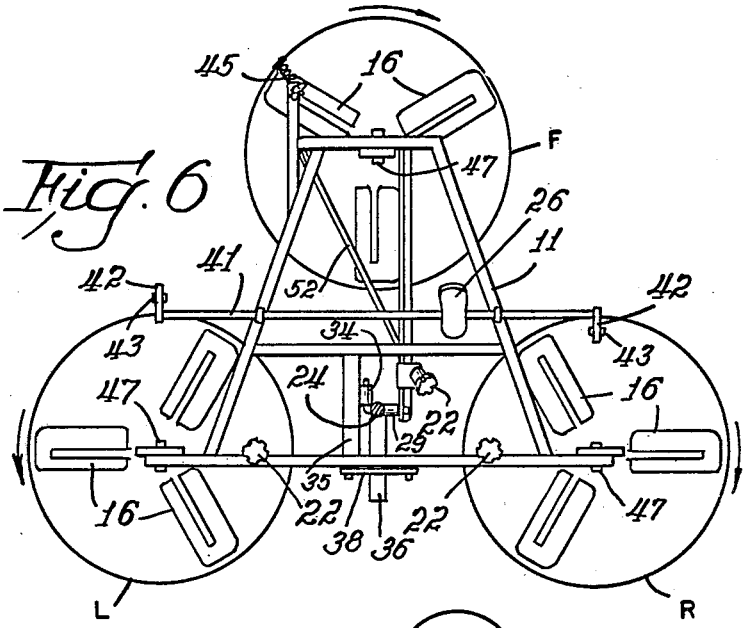
FIG. 6 is a skeletonized view of the apparatus seen from above.

Single rotor troweling machines conventionally are provided with a lever such as lever 51 in FIG. 3 which is drawn upwardly to control the pitch or raising of the toes of all of the trowels on the rotor. In the machine of FIGS. 1 to 16, each of the pitch controls is extended to a point of easy access by the operator. Thus in FIG. 5, it is seen that the lever 51 of rotor F is connected by cable 52 extending around pulley 53 to a screw-type tensioning device 54, as seen best in FIG. 5. In the case of the two rear rotor assemblies R and L the screw devices 54 are more directly connected to the respective pitch levers. In all instances, turning the handle 22 raises the lever 51 to increase the pitch of the trowels of the associated rotor.

ADDITIONAL DETAILS

The construction of the various rotor assemblies is already known and therefore need not be described or fully illustrated. Such rotors are sold by various companies as power trowelers, troweling machines, or finishing machines. As these are sold, they are single-rotor machines with a handle-carrying control post extending upwardly and outwardly from the gear box, and an engine mounted on top of the gear box. In FIGS. 1-16 the same gear box is used, but with the universally pivoting connection with the frame as described. The gear box includes a worm drive.

The seat illustrated happens to be a form usually carried by a leaf spring, but rigid mounting is preferred and has been illustrated. Of course it is also possible to have the seat face in the opposite direction, with suitable relocation of the controls to be convenient for an operator thus seated.

OTHER USES

This invention may of course be used for other purposes. Besides substituting other forms of concrete-working blades on the rotors, scrubbing or polishing brushes or sanding or grinding elements could be used. Indeed, with brushes or pads in place of the blades, the vehicles could be used for amusement purposes, the surface working then being only incidental, or the means of accomplishing the varied movements for amusement. In some uses, an accessory may be advantageous for spraying liquid or spreading powder or the like.

ACHIEVEMENT BY THREE-ROTOR FORM

The form of the machine of this invention as shown in FIGS. 1 to 16 has been found to be exceptionally satisfactory for troweling the surface of large cement areas. Its triangular arrangement of three rotors permits troweling in the course of one path a band almost as wide as three times the rotor diameter. The triangular arrangement also provides a staggering which is much more desirable than having two rotors in alignment. The triangular arrangement also gives very great stability, with sufficiently uniform distribution of the total weight between the three rotors so that variations in the weight of the operators causes no trouble. These same principles can be applied with more than three rotors, preferably arranged along two sides of a triangle, i.e. in a "V" pattern.

The control of the movements is exceedingly satisfactory and most of the time is accomplished simply by a movement of the control stick. Operating the pedal when crabbing is occasionally desired is also very convenient. The problem of tracks left by a walking operator is entirely eliminated, and in fact the weight of the riding operator increases the effectiveness of the machine, at least under some circumstances.

IMPROVED CONTROL FEATURES

Figure 17:
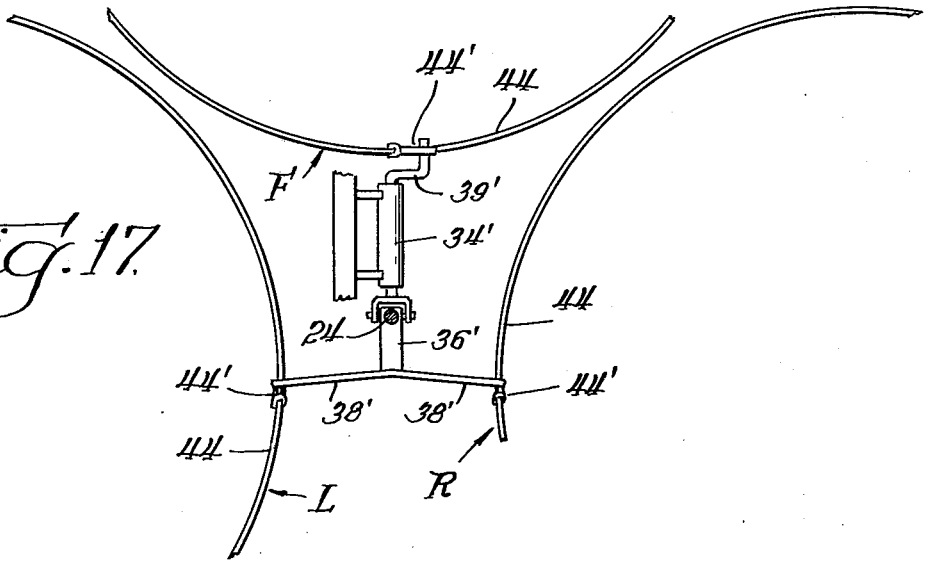
FIG. 17 is a fragmentary plan view illustrating improved details for the control stick construction and mounting.
Figure 18:
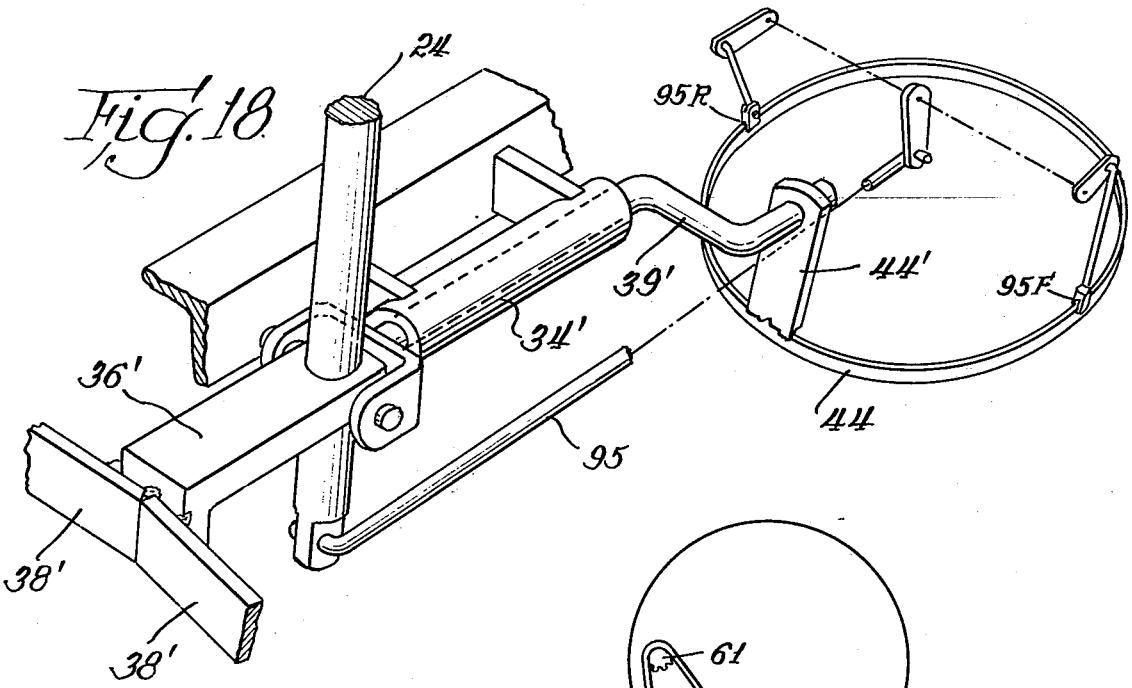
FIG. 18 is a fragmentary view of perspective nature of the control stick structure of FIG. 17, showing also a further improvement for imparting a downward thrust at one side or the other of the forward rotor to impart to it a forward or reverse drive effect.

FIGS. 17 and 18 illustrate some control features which represent improvements over the control illustrated in FIGS. 1 to 16. One of the improvements is in having the rearwardly extending control lever 36' on the axis of the fixed tube 34' so that sidewise tilting of the control stick 24 tilts the control lever 36' without raising or lowering it. Levers 38' which are rigidly connected to the control lever 36' may be directly connected to the rings 44 of rotors R and L by upstanding links 44' pivoted to (or possibly rigid with) the respective rings 44.

As another improvement, the pressure which in FIG. 13 was applied to the front rotor through the tilt lever 39F is now applied instead by a crank arm 39' which more simply and directly raises or lowers the rear edge of ring 44 to apply a tilting force to rotor F. Crank 39' may be connected to ring 44 by a lug or connecting link 44' which may extend rigidly from or be pivoted to ring 44.

COUPLED PITCH CONTROL

Figure 19:
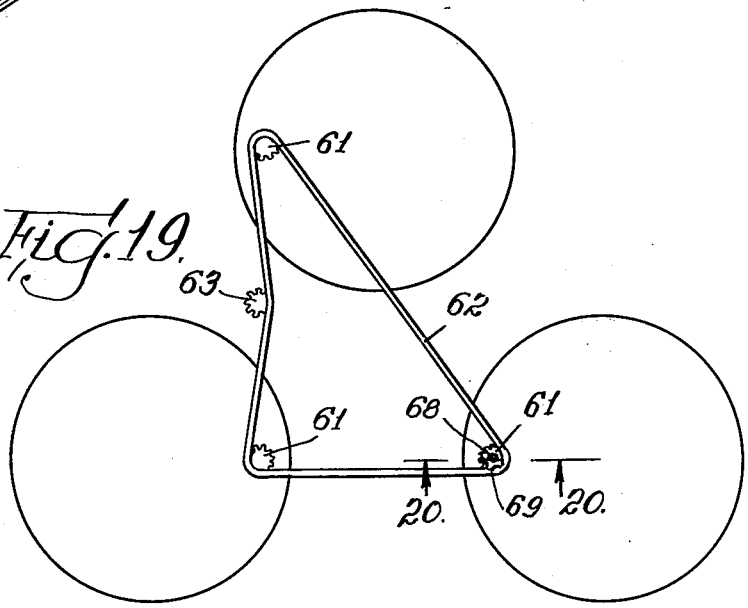
FIG. 19 is a schematic view illustrating the coupling of the three tilt control adjustments.

Instead of having three pitch control knobs 22 as in FIG. 1, it is at present preferred to couple the pitch control devices as is diagrammatically illustrated in FIG. 19.

Here each pitch control device is actuated by sprockets 61, and the three sprockets are coupled by a chain 62, made backlach-free by an adjustable tightening roller or sprocket 63. Instead of one chain as shown, two chains could be used, each coupling only two of the control shafts, one having a double sprocket.

Figure 21:
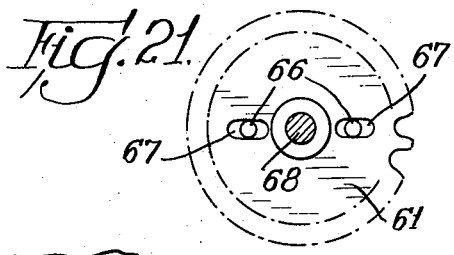
FIG. 21 is a view looking down on the sprocket of FIG. 20 with a section through the control shaft at approximately the line 21—21.
Figure 20:
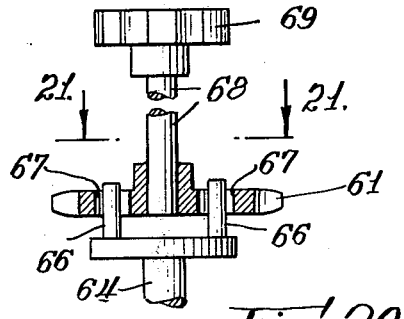
FIG. 20 is a fragmentary view partly in vertical section showing details of the type of control which may be coupled as in FIG. 19, this section being approximately that of the line 20—20 of FIG. 19.

FIGS. 20 and 21 show details which may be used if the sprockets 61 are carried by the frame 11, in which case each pitch control shaft 64 would have some movement vertically and angularly with respect to its associated sprocket 61. Such movements can be accommodated in the manner shown in FIGS. 20 and 21 by a flexible and extendable coupling. Thus shaft 64 carries spaced pins 66 which extend through slots 67 in sprockets 61, the slots 67 having snug fits with the pins 66 in the circumferential direction so as not to permit appreciable backlash. The sprocket 61 most convenient to the operator would have a control shaft 68 extending upwardly to a knob by which the operator could turn all three control shafts 64 simultaneously and equally.

DOUBLE GEAR DRIVE

Figure 22:
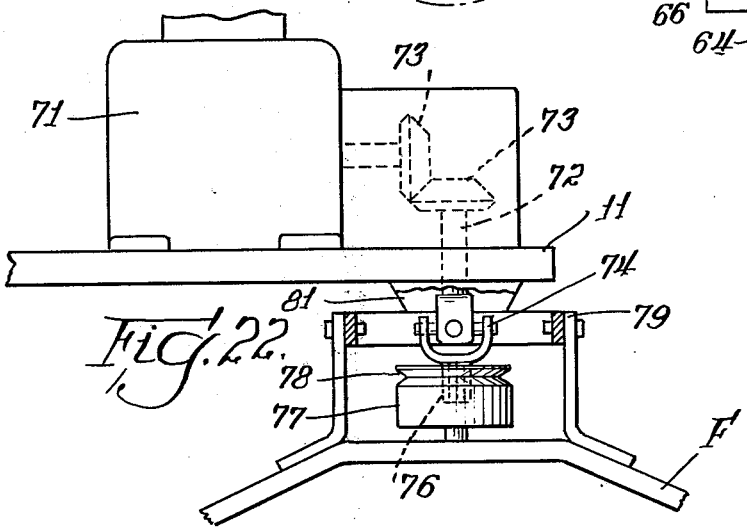
FIG. 22 is a view illustrating one suitable manner of using a double geared drive for driving the rotors.

In place of the driving detail shown in FIG. 1, some manufacturers may prefer a bevel gear drive with direct belt drives connecting the rotors, as illustrated in FIG. 22. Here an engine 71 is mounted on frame 22 and drives a vertical shaft 72 through bevel gears 73. With this construction, it is desirable to provide two concentric universal joints. Universal joint 74 connects vertical drive shaft 72 with a generally vertical but angularly shiftable drive shaft 76. This drives pulley 77 which drives one of the rotors such as rotor F and is provided with one or more V grooves 78 for a belt or belts driving the other rotors. The rotor F should be supported independently of the drive shaft, which in fact is slightly telescopic, and for this purpose a second universal joint 79 is provided for coupling the rotor F with universal action to downwardly extending legs 81 carried rigidly by frame 11.

TWO-ROTOR FORM

Figure 23:
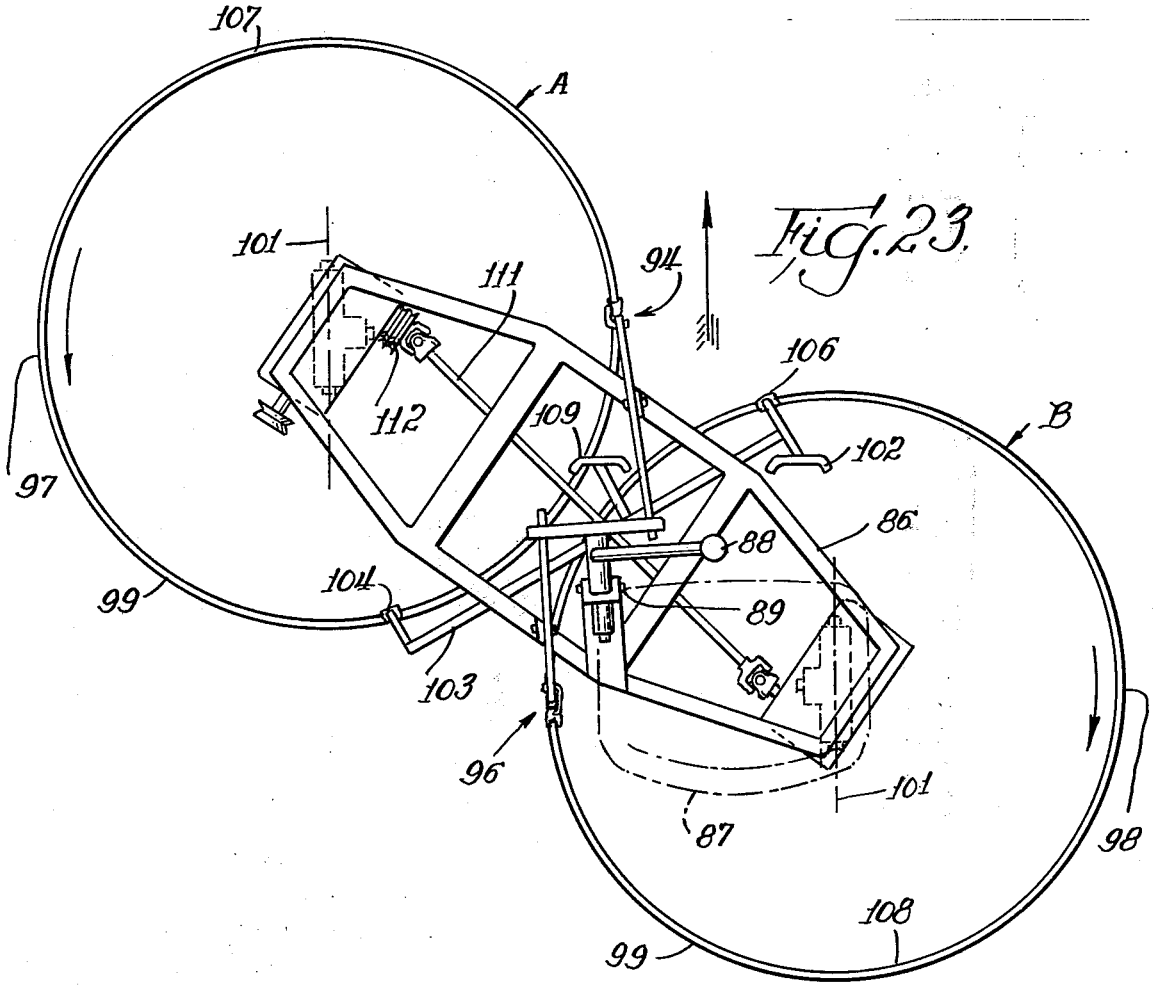
FIG. 23 is a plan view of a two-rotor form of the invention which may be preferred by some purchasers for cost reduction purposes.
Figure 24:
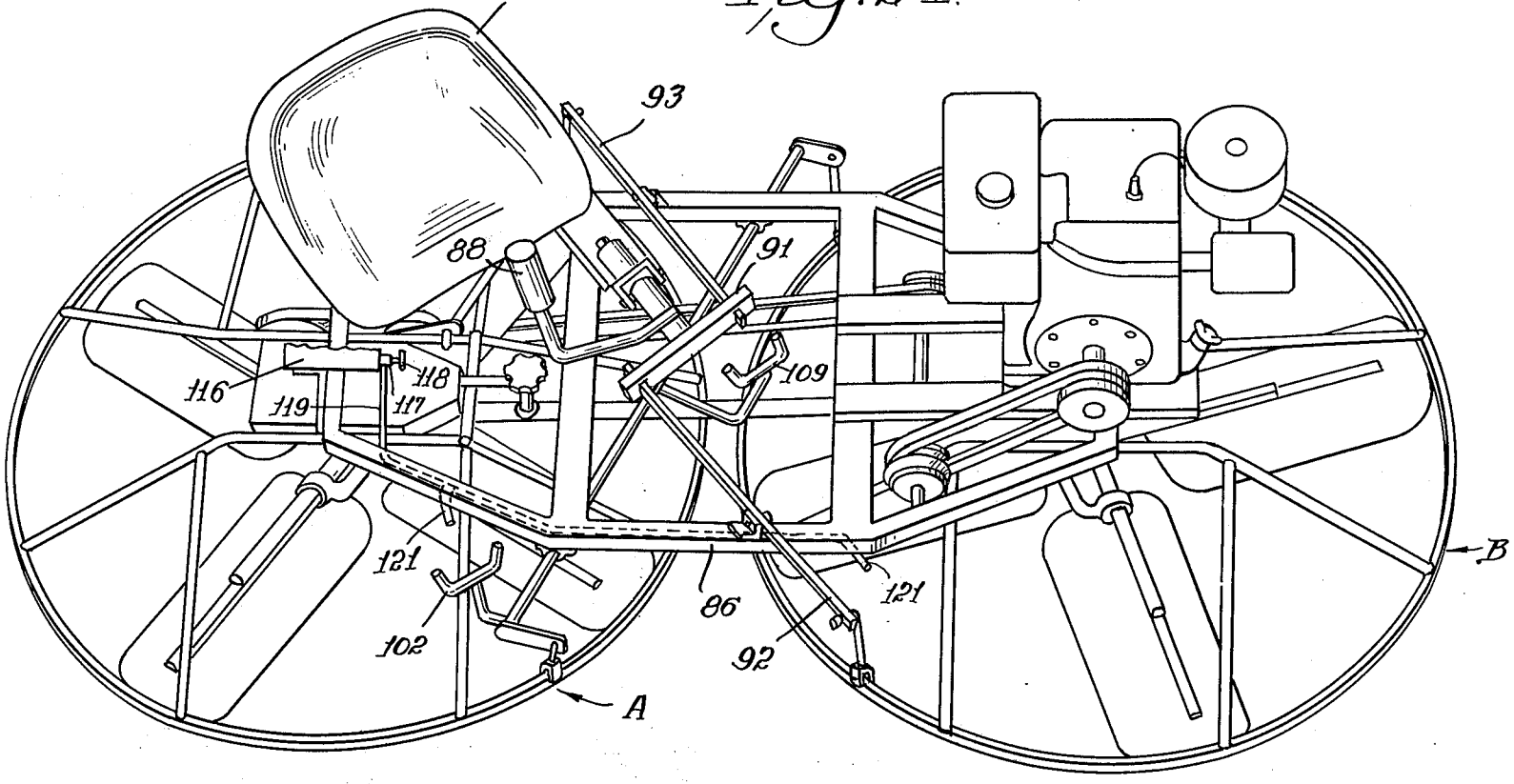
FIG. 24 is a perspective type view of the two-rotor form of the invention of FIG. 23.

FIGS. 23 and 24 show a two-rotor form of the invention which can be manufactured at lower cost and which performs in a manner reasonably comparable to that of the three-rotor form of FIGS. 1 to 16. Details of construction are seen best in FIG. 24. No detailed description is believed to be necessary, to the extent that the construction is similar to that of FIGS. 1 to 16 except for having only two rotors instead of three and hence having a modified frame 86. The two rotors are in this instance designated A and B. The operator's seat 87 is placed on the frame facing diagonally as seen in FIG. 24 because it is contemplated that the main direction of movement will be in the direction of the arrow in FIG. 23 which is forwardly with respect to the seat position shown in FIG. 24. With this direction of movement, there is a moderate overlap of the surface-working paths of rotors A and B so that even with slight changes of direction no unworked strips will appear between them. In this connection it is noted that in the three-rotor form, some purchasers may prefer to have the rear rotors a little closer together than in FIG. 4 so as to have more overlap with the work path of the front rotor, and less risk of leaving an area or strip relatively unworked.

Forward movement of the control stick 88 will rock the control assembly about pin 89 thereby depressing bar 91 and rocking levers 92 and 93 about pivotal points of connection with frame 86. In this way a lifting pressure is applied to rotor A at point 94 and to rotor B at point 96. Each of these actions produces a relatively greater downward force at the opposite points 97 and 98. At each of these points 97 and 98 the rotor blades are moving rearwardly so that the reaction to the increased friction from the downward pressure thereon moves the surface-working vehicle forwardly, in the direction of the arrow of FIG. 23. Rearward movement of the control stick 88 will have the opposite effect, increased pressure of the rear blades on the worked surface being applied in the vicinity of points 94 and 96 where the blades are moving forwardly so that the reaction will move the machine rearwardly.

Preferably movement of the machine is in each instance aided by causing the forward rotor F to contribute to the forward or rearward movement. In FIG. 18 this is accomplished (in response to forward or rearward movement of stick 24) by link 95 and parts moved by it as indicated to press down at point 95F for forward movement and at 95R for rearward movement.

For swinging right, the stick 88 is tilted to the right. This applies pressure in the vicinity of point 97 to move rotor A forwardly and in the vicinity of point 97 to move rotor B rearwardly. One advantage of having the machine's forward direction be with a diagonal position shown in FIG. 23 is that these best pressure points for forward or rearward movement can be well removed from the points 99 which are the extreme side points relative to the longitudinal axis of the frame 86. Attempting to apply pressure at the two points 99 would not accomplish much on a two-rotor machine because there is no third rotor to impart lateral stability to the frame, and the attempt to apply pressure at points 99 might have more effect in tilting the frame than in applying pressure.

To turn the machine to the left, the stick 88 is swung to the left, applying pressure at the points 94 and 98.

It is preferred that the universal joints by which the rotors A and B are connected to frame 86 be mounted with one axis (indicated at 101 in FIG. 23) parallel to the direction of movement. This permits the most common tilting actions, those already described, to rock about a single axis.

To make the machine "crab" to the right, foot pedal 102 is pressed. This rocks shaft 103 in a direction to apply lifting force at points 104 and 106, thereby applying pressure in the vicinity of points 107 and 108. At both of these points the rotor blades are moving toward the left so that the reaction is toward the right. For crabbing to the left, pressure is applied to foot pedal 109, with opposite effect. If this crabbing produces any undesired tendency towards forward or rearward movement, it may be corrected by appropriate movement of stick 88 slightly forwardly or rearwardly.

FIG. 23 also illustrates an optional coupling of the drive of the two rotors A and B by a drive shaft 111 which should have universal joints as illustrated and a telescopic section as indicated at 112.

SPREADING TREATMENT MATERIAL

An important advantage of the machine of the present invention is that it can be used for spreading treatment material as the surface-working operation proceeds, all without leaving any tracks. This is illustrated in FIG. 24 on the assumption that the treatment material is a liquid. Such liquid could be, for example, a material which will impart surface hardness, or surface resistance to salt or, when the situation permits, water for facilitating the final surface working. A tank 116 is fragmentarily indicated with a valve 117 having a handle 118 accessible to the operator and controlling flow to a distribution pipe 119 having nozzles 121 for each rotor. There would be three such nozzles for a three-rotor machine. Preferably each nozzle is directed well within the periphery of the rotor. A spray action is preferred for spreading the treatment material, although it will be spread considerably by the blades and by the moving action of the machine. A pressurized tank may be preferred to achieve better spraying action. If the surface acting material is a material of solid comminuted nature, a driven metering spreader over each rotor may be preferred.

We claim:

1. A ride-type surface-working machine comprising three driven rotors rotating about widely spaced generally vertical axes with each rotor engaging the supporting surface with surface-working means distributed about the rotor axis and which follow an annular path along a supporting surface, a frame carried by the rotors and supporting driving means for the rotors and an operator's position, said rotors being mounted on the frame by means permitting relative tilting of each rotor about one or more horizontal axes, and control means operatively related to said frame and rotors and controllable by an operator riding on the frame for applying selectively tilting pressures to the rotors, the tilting pressure applied to a rotor tending to tilt the entire rotor unit about a horizontal axis, for controlling the posture and movement of the machine by variations of downward working pressure distribution; said control means including means for applying tilting pressures to all three rotors, to one side of each for forward movement of the machine and alternatively to opposite sides of each for rearward movement of the machine.

2. A ride-type surface-working machine comprising a plurality of driven rotors rotating about widely spaced generally vertical axes with each rotor engaging the supporting surface with surface-working means distributed about the rotor axis and which follow an annular path along a supporting surface, a frame carried by the rotors and supporting driving means for the rotors and an operator's position, said rotors being mounted on the frame by means permitting relative tilting of each rotor about one or more horizontal axes, and control means operatively related to said frame and rotors and controllable by an operator riding on the frame for applying selectively tilting pressures to the rotors, the tilting pressure applied to a rotor tending to tilt the entire rotor unit about a horizontal axis, for controlling the posture and movement of the machine by variations of downward working pressure distribution.

3. A ride-type surface-working machine according to claim 2, in which the control means includes means for oppositely tilting two oppositely driven spaced rotors to drive the machine in a given direction.

4. A ride-type surface-working machine according to claim 2, in which the control means includes means for oppositely tilting two oppositely driven spaced rotors to drive the machine in a given direction and provides similarity of tilting for changing the posture of the machine.

5. A ride-type surface-working machine according to claim 2 in which there are exactly two of said rotors.

6. A ride-type surface-working machine according to claim 2 in which there are exactly two of said rotors, an operator's seat carried by the frame faces at a substantial angle from a line through both of their axes, and the pressures for forward and rearward movements are applied at a substantial angular separation from the radii of the rotors perpendicular to said line.

7. A ride-type surface-working machine according to claim 2 including means for applying the tilting pressure comprising a control stick pivoted on a first axis generally parallel to a preferred direction of movement and pivoted on a second axis substantially intersected by the first axis, control means for one type of movement controlled by stick movement about one axis, control means for another type of movement controlled by stick movement about the other axis;

each control means being substantially unaffected by stick movement about the axis which controls the other control means.

8. A ride-type surface-working machine according to claim 2 in which each rotor includes surface-working blades and pitch control means for the blades, and said pitch control means are coupled for joint control from the operator's position.

9. A ride-type surface-working machine according to claim 2 including means for dispensing treatment material, under control of the operator in the operator's position, into the work area of at least one rotor.

10. A ride-type surface-working machine comprising at least three driven rotors rotating about widely spaced generally vertical axes in staggered arrangement with each rotor engaging the supporting surface with surface-working means distributed about the rotor axis and which follow an annular path along a supporting surface, a frame carried by the rotors and supporting driving means for the rotors and an operator's position, said rotors being mounted on the frame by means permitting relative tilting of each rotor about one or more horizontal axes, and control means operatively related to said frame and rotors and controllable by an operator riding on the frame for applying selectively a tilting pressure between the frame and one or more of the rotors to produce more downward working pressure on one side of its axis than on the opposite side, the tilting pressure applied to a rotor tending to tilt the entire rotor unit about a horizontal axis, for controlling the posture and movement of the machine by variations of downward working pressure distribution.

11. A ride-type surface-working machine according to claim 10 in which two of the rotors are rotated in opposite directions, and the control means includes means for tilting them oppositely to move the machine along a line passing between them and through the third rotor to surface-work three overlapping bands.

12. A ride-type surface-working machine according to claim 10 in which two of the rotors are rotated in opposite directions, and the control means includes means for tilting them oppositely to move the machine along a line passing between them and through the third rotor to surface-work three overlapping bands and in which the tilting pressures can be applied to the third rotor, forwardly or rearwardly with respect to movement along said line to change the posture of the machine.

13. A ride-type surface-working machine according to claim 10 in which two of the rotors are rotated in opposite directions, and the control means includes means for tilting them oppositely to move the machine along a line passing between them and through the third rotor to surface-work three overlapping bands and in which the tilting pressures can be applied to the third rotor, forwardly or rearwardly with respect to movement along said line to change the posture of the machine;

said surface-working means comprising concrete finishing tools.

14. A ride-type surface-working machine according to claim 10 in which two of the rotors are rotated in opposite directions, and the control means includes means for tilting them oppositely to move the machine along a line passing between them and through the third rotor to surface-work three overlapping bands and in which the tilting pressures can be applied to the third rotor, forwardly or rearwardly with respect to movement along said line to change the posture of the machine;

said surface working-means comprising concrete finishing tools; and each rotor including means for adjusting the pitch of said tools.

15. A ride-type surface-working machine comprising a plurality of driven rotors rotating about widely spaced generally vertical axes with each rotor engaging the supporting surface with surface-working means distributed about the rotor axis and which follow an annular path along a supporting surface, a frame carried by the rotors and supporting driving means for the rotors and an operator's position, said rotors being mounted on the frame by means permitting relative tilting of each rotor about one or more horizontal axes, and control means operatively related to said frame and rotors and controlled through a single control stick, mounted on the frame to be universally swingable, by an operator riding on the frame for applying selectively tilting pressure to the rotors, the tilting pressure applied to a rotor tending to tilt the entire rotor unit about a horizontal axis, for controlling the posture and movement of the machine by variations of downward working pressure distribution.

* * * * *

UNITED STATES PATENT OFFICE

CERTIFICATE OF CORRECTION

PATENT NO. : 3,936,212

DATED : February 3, 1976

INVENTOR(S) : Orville H. Holz, Sr. and Norbert J. Holz

It is certified that error appears in the above-identified patent and that said Letters Patent are hereby corrected as shown below:

| | |
|---|---|
| Col. 3, line 17 | "jot" should be --not-- |
| Col. 3, line 30 | "operator'operator3s" should be --operator's-- |
| Col. 3, line 34 | "includes" should be --included-- |
| Col. 3, line 35 | "machanes" should be --machines-- |
| Col. 4, line 31 | before "swing control bar" insert --movements-- |
| Col. 4, line 31 | "for" should be --or-- |
| Col. 5, line 37 | "39L,R," should be --39L, 39R,-- |
| Col. 6, line 57 | "toruble" should be --trouble-- |
| Col. 7, line 64 | after "desired" insert --and-- |
| Col. 8, line 31 | "backlach" should be --backlash-- |
| Col. 8, line 40 | "extendable" should be --extendible-- |
| Col. 8, line 42 | "having snug fits" should be --fitting snugly-- |

Signed and Sealed this

Fifth Day of October 1976

[SEAL]

*Attest:*

RUTH C. MASON
*Attesting Officer*

C. MARSHALL DANN
*Commissioner of Patents and Trademarks*